US005410775A

United States Patent [19]

Frazier

[11] Patent Number: 5,410,775

[45] Date of Patent: May 2, 1995

[54] APPARATUS FOR POWERED COLLECTION OF LOOSE-FILL PACKAGING MATERIAL

[76] Inventor: Thomas N. Frazier, 195 State St., San Mateo, Calif. 94401

[21] Appl. No.: 95,605

[22] Filed: Jul. 21, 1993

[51] Int. Cl.[6] ..... A47L 5/24

[52] U.S. Cl. ..... 15/338; 15/327.5; 15/339; 15/352

[58] Field of Search ..... 15/257.2, 339, 338, 15/352, 353, 327.5

[56] References Cited

U.S. PATENT DOCUMENTS

| | | | |
|---|---|---|---|
| 2,346,339 | 4/1944 | Vose | 15/352 X |
| 2,626,418 | 1/1953 | Kelly et al. | 15/344 X |
| 4,574,419 | 3/1986 | Lex | 15/344 X |
| 4,713,858 | 12/1987 | Kelber . | |
| 4,747,178 | 5/1988 | Breitbach | 15/352 X |
| 4,780,986 | 11/1988 | Broomfield et al. . | |
| 4,780,986 | 7/1989 | Aasen . | |
| 4,928,346 | 5/1990 | Elson et al. . | |
| 4,993,107 | 2/1991 | Zoni . | |
| 5,040,263 | 8/1991 | Gühne et al. | 15/327.5 |

FOREIGN PATENT DOCUMENTS

| | | | |
|---|---|---|---|
| 935992 | 5/1955 | German Dem. Rep. | 15/338 |

*Primary Examiner*—Christopher K. Moore

*Attorney, Agent, or Firm*—James E. Eakin; Janet K. Castaneda

[57] ABSTRACT

An attachment for the majority of conventional vacuum cleaners and reversible blower devices for collecting lightweight, loose-fill packaging materials for disposal or reuse includes two, nesting sections. The first section, when used alone, releasably attaches over the bin or the body of a portable, hand held vacuum cleaner. An inlet end defines an irregular collection edge to aid in preventing entry of dust and extraneous, heavier materials. A one-way, hinged door defining perforations allows air to enter to move previously collected packaging material away prior to opening of the door to admit additional packaging material. For full sized vacuum cleaners, the first section removably mounts through an aperture formed in an end wall of a larger receptacle having a universal coupler for attachment to the hose or hose coupler of the majority of full sized vacuum cleaners. The first section may be made larger and used alone to attach to a full sized vacuum cleaner.

14 Claims, 9 Drawing Sheets

APPARATUS FOR POWERED COLLECTION OF LOOSE-FILL PACKAGING MATERIAL

FIELD OF THE INVENTION

This invention relates to apparatus for powered collection of lightweight, loose-fill materials for re-use or disposal. Specifically, the invention is an attachment for conventional, powered suction devices, such a vacuum cleaners or reversible blowers, for collecting lightweight, loose-fill, packaging materials such as foam "peanuts" or "popcorn".

BACKGROUND OF THE INVENTION

Lightweight, loose-fill packaging materials are difficult to collect for re-use or disposal because the generally weightless materials, for example polystyrene foam "peanuts" or "popcorn", typically blow away in the presence of minimal air movement, and such materials may cling to the collecting device. Such lightweight packaging materials may also be made from corn and potato starches, wood pulp and scraps, paper fibers, and other biodegradable materials.

Conventional vacuum cleaners and the like, particularly larger industrial cleaners, have been used to collect loose-fill packaging materials. Additionally, blower devices have been used to direct a source of air towards such materials to move them to a specific location for collection by a vacuum cleaner, a broom and dust pan, or by hand.

Generally, commercially available vacuuming devices create suction to draw materials into a nozzle and through a hose to a collection receptacle, or with hand held vacuuming devices, through an attached nozzle directly into a collection receptacle. Typically, individual pieces of commonly used, loose-fill packaging materials are designed to interlock and are manufactured using in an expansion process to occupy as much space per weight as possible. When drawn into a conventional vacuuming device such materials may interlock and clog the hose thereby requiring the operator to repeatedly disconnect and unblock the hose. Also, many of the collection containers of conventional vacuum cleaners are not large enough to hold any sufficient volume of the loose-fill materials thereby inconveniencing the operator with repeated emptying operations. Additionally, loose-fill packaging materials commingle with dirt in the collection container, or dirt collected with the packaging materials, rendering re-use of loose-fill material impractical. Re-use of loose-fill packaging materials is desirable because of cost and ecological considerations.

Using a blower device to move loose-fill packaging material to a specific area for collection generally creates a cloud of dust or dirt thereby causing discomfort, health hazards, and possibly physical harm to persons within the vicinity.

When not collected and disposed of, biodegradable loose-fill materials, such as corn starch, will begin to decompose when subjected to high humidity or wet conditions thereby creating a danger to persons who may slip and fall on the decomposing material. Additionally, decomposing biodegradable materials may attract insects and rodents thereby creating a health hazard. When not collected and disposed of, non-biodegradable material may be blown out into the environment creating a public nuisance.

Prior art attempts to use power to clean up and collect loose-fill packaging materials have centered around using conventional vacuum devices, particularly industrial vacuum cleaners. Such devices, in addition to the clogging described above, generally produce high suction at the intake thereby collecting and intermingling large amounts of extraneous dirt and objects with the loose-fill packaging materials making re-use of the packaging materials difficult without separation from the unwanted materials. While industrial collection and filtering devices are known in the prior art for separating solid and powder refuse, one such device is described in U.S. Pat. No. 4,993,107, such devices are expensive and impractical for the small shop or individual user.

Although specialty attachments for conventional vacuum cleaners exist in the prior art, none appear suited to collect lightweight, loose-fill packaging materials. One such attachment is a power brush that snap mounts to a hand-held vacuum cleaner as described in U.S. Pat. No. 4,928,346. U.S. Pat. No. 4,713,858 describes a leaf collection attachment for a vacuum or blower device. The leaf attachment defines three attachment ports. One port attaches to the vacuum device, a second port attaches to a conventional collection hose, and a third port, generally at a right angle to the second port, attaches to a collection device. The leaf attachment does not appear adaptable for use with portable, hand held, smaller vacuum cleaners. Other attachments for vacuum cleaners described in U.S. Pat. Nos. 4,780,986 and 4,279,095 use suction to trap insects in small chambers.

As may be seen from the above discussion of the prior art, an unsolved need exists for an easy to use device for attachment to the majority of conventional vacuum cleaners and the like for collection and disposal or re-use of variable quantities of a variety of lightweight loose-fill packaging materials.

SUMMARY OF THE INVENTION WITH OBJECTS

A general object of the invention is to provide an apparatus for the powered collection of lightweight loose-fill packaging materials that overcomes the limitations and drawbacks of the prior art.

A specific object of the invention is to provide an apparatus for the powered collection of lightweight loose-fill packaging materials that is inexpensive, easy to use, and may be easily and detachably connected to the majority of conventional vacuum or blower devices, including portable, hand held vacuum cleaners, full sized vacuum cleaners, and industrial vacuum cleaners.

Another specific object of the invention is to provide an apparatus for the powered collection of lightweight loose-fill packaging materials having two sections, a first section attached within the second section. The first section removable for attachment to a small, hand held portable vacuum cleaner for small collection operations. The second section, with the first section installed therein, for attachment to a full sized vacuum cleaner and serving as a receptacle for collection of larger volumes of the lightweight, loose-fill packaging materials.

Yet another specific object of the invention is to provide an apparatus for the powered collection of lightweight loose-fill packaging materials having a sufficiently large inlet opening defining an irregular edge which, in conjunction with reduced suction at the larger inlet, collects loose-fill material and does not collect most extraneous heavier materials and dirt.

Still another specific object of the invention is to provide an apparatus for the powered collection of lightweight loose-fill packaging materials having a collection receptacle with an interior space of a size sufficient to isolate relatively large volumes of collected loose-fill packaging materials from extraneous material and hold the collected packaging materials for disposal or reuse.

Yet one more specific object of the invention is to provide an apparatus for the powered collection of lightweight loose-fill packaging materials having multiple attachment mechanisms for attachment to a conventional hose or hose coupling of a vacuum cleaner, over the dust bin of a hand held portable vacuum cleaner, or to the body of a hand held portable vacuum cleaner with the dust bin thereof removed.

Still another specific object of the invention is to provide an apparatus for the powered collection of lightweight loose-fill packaging materials having a one way inlet door that closes in the absence of suction to prevent the collected loose-fill material from falling out of the apparatus.

Still one more specific object of the invention is to provide an apparatus for the powered collection of lightweight loose-fill packaging materials having an inlet door defining perforations to enable air to be drawn into the apparatus to move previously collected material away from the door thereby allowing the door to open to collect additional loose-fill packaging material.

One more specific object of the invention is to provide an apparatus for the powered collection of lightweight loose-fill packaging materials having a screen to prevent collected loose-fill material from entering the hose or existing collection receptacle of a conventional vacuuming device, the screen further collecting any extraneous dust or dirt.

One additional specific object of the invention is to provide an apparatus for the powered collection of lightweight loose-fill packaging materials having a convenient collection receptacle for ease of emptying segregated loose-fill material from its outlet end into any container for re-use or disposal.

One further specific object of the invention is to provide an apparatus for the powered collection of lightweight loose-fill packaging materials that may be used while standing in an upright position thereby functioning in an ergonomic manner as an extension of the users arm and/or hand.

In accordance with the present invention, an apparatus for the powered collection of lightweight loose-fill packaging materials is provided for removable attachment to the majority of powered vacuuming and reversible blower devices.

In a first aspect for attachment to a portable, hand held vacuum cleaner, the collection device defines a body having an outlet end and an inlet end with an interior chamber therebetween. The outlet end slides over and connects to the dust bowl of the vacuum cleaner. The inlet end defines a one- way, perforated door that opens when suction is created by the vacuum cleaner. An edge of the inlet end is preferably irregular to minimize contact with the surface bearing the packaging material to be collected thereby preventing collection of most dirt, fine particles, and heavier objects intermingled with the packaging materials. The inlet is also sufficiently large that, in conjunction with the amount of suction created by a hand held vacuum cleaner at the inlet, heavier materials and dirt are generally not collected with the lightweight loose-fill packaging materials.

An optional screen or filter may be provided at the outlet end to prevent the loose-fill material from entering the vacuum cleaner, although the generally angled edge and smaller opening of such conventional portable vacuum cleaners typically prevents entry of the loose-fill materials. When a filter device is added, it is preferably hinged at an edge to the bottom of the side walls of the collection chamber to enable it to be dropped down flush with the bottom wall to empty the chamber when the collection device is detached from the vacuum cleaner.

In a second aspect of the invention, the collection device described above is installed within a larger, second collection receptacle for attachment to the hose of the majority of conventional vacuum cleaners. The hollow, larger collection receptacle defines a front wall and a rear wall. The front wall defines an opening therethrough for insertion of the smaller collection device therein. A bracket is provided through the top wall of the larger collection receptacle to secure the position of the inserted smaller collection device therein. The inlet end of the smaller collection device protrudes from the front wall and is used to collect the loose-fill material as previously described. When the collected loose-fill material reaches the outlet end of the smaller collection device, it drops down into the interior space of the larger receptacle. The back wall of the larger collection receptacle opens to empty the interior space and defines a universal, releasable hose attachment for connection to the hose of the majority of conventional, full sized vacuum cleaners. Preferably, the outer housing of the larger collection receptacle defines a hand grip and a shoulder strap mechanism for support and to enable the user to easily direct the inlet end to the loose-fill material to be collected. It is preferable that the first collection device, when used alone or installed within the second collection chamber, is of a length sufficient to enable the user to stand upright while collecting the lightweight, loose-fill packaging material. As can be seen, the length of the collection device, coupled with the size and configuration of the inlet door, provides sufficient suction to open the inlet door, collect the ultra-light packaging materials, but insufficient suction to collect extraneous dirt and heavier materials.

These and other objects, aspects, advantages and features of the present invention will be more fully understood and appreciated upon consideration of the following detailed description of preferred embodiments, presented in conjunction with the accompanying drawings.

BRIEF DESCRIPTION OF THE DRAWINGS

In the drrawings.

DESCRIPTION OF PREFERRED EMBODIMENTS

A collection device for attachment to a conventional hand held, portable vacuum cleaner and embodying the principles of the present invention is shown generally at 20 in FIGS. 1 through 4B. The collection device 20 may be constructed from lightweight metals, plastic materials, synthetic or composite material, lightweight corrugated cardboard, or heavy cardboard. Transparent plastic is preferred to enable the user to easily see when the collection device 20 is filled. A viewing window or strip is preferably added during construction when the device is made from non-transparent materials.

Figure 1:
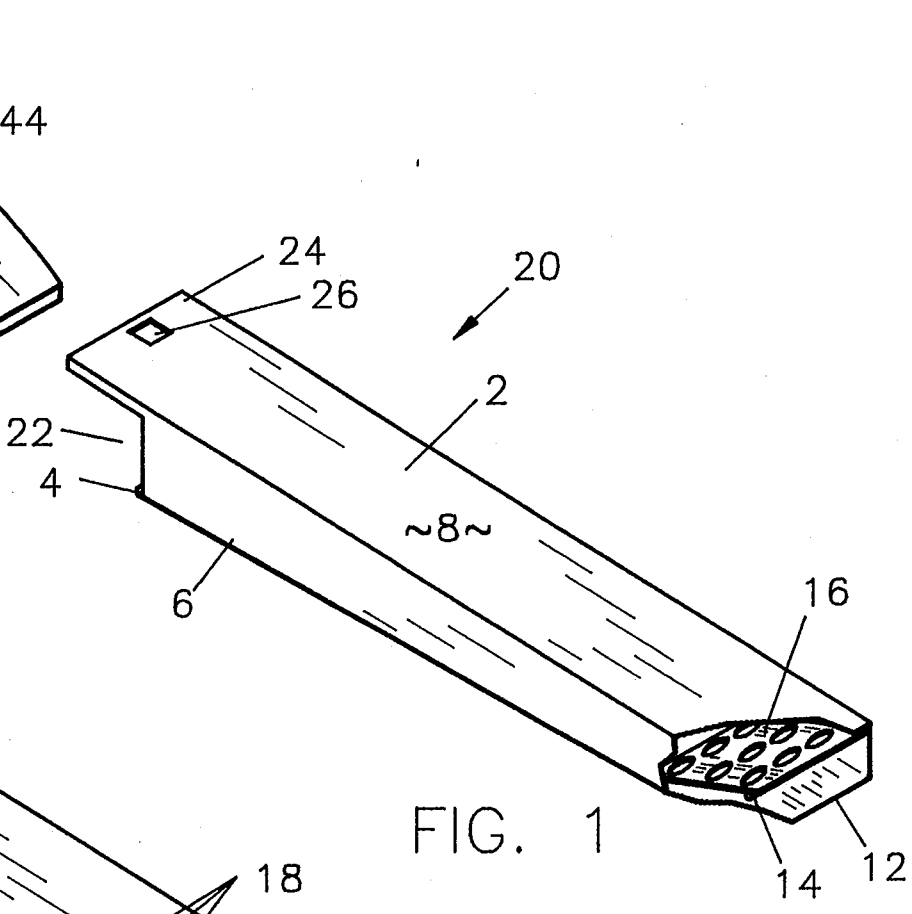
FIG. 1 is a an elevated perspective view of a preferred collection device shown prior to attachment to a conventional hand held, portable vacuum cleaner.
Figure 2:
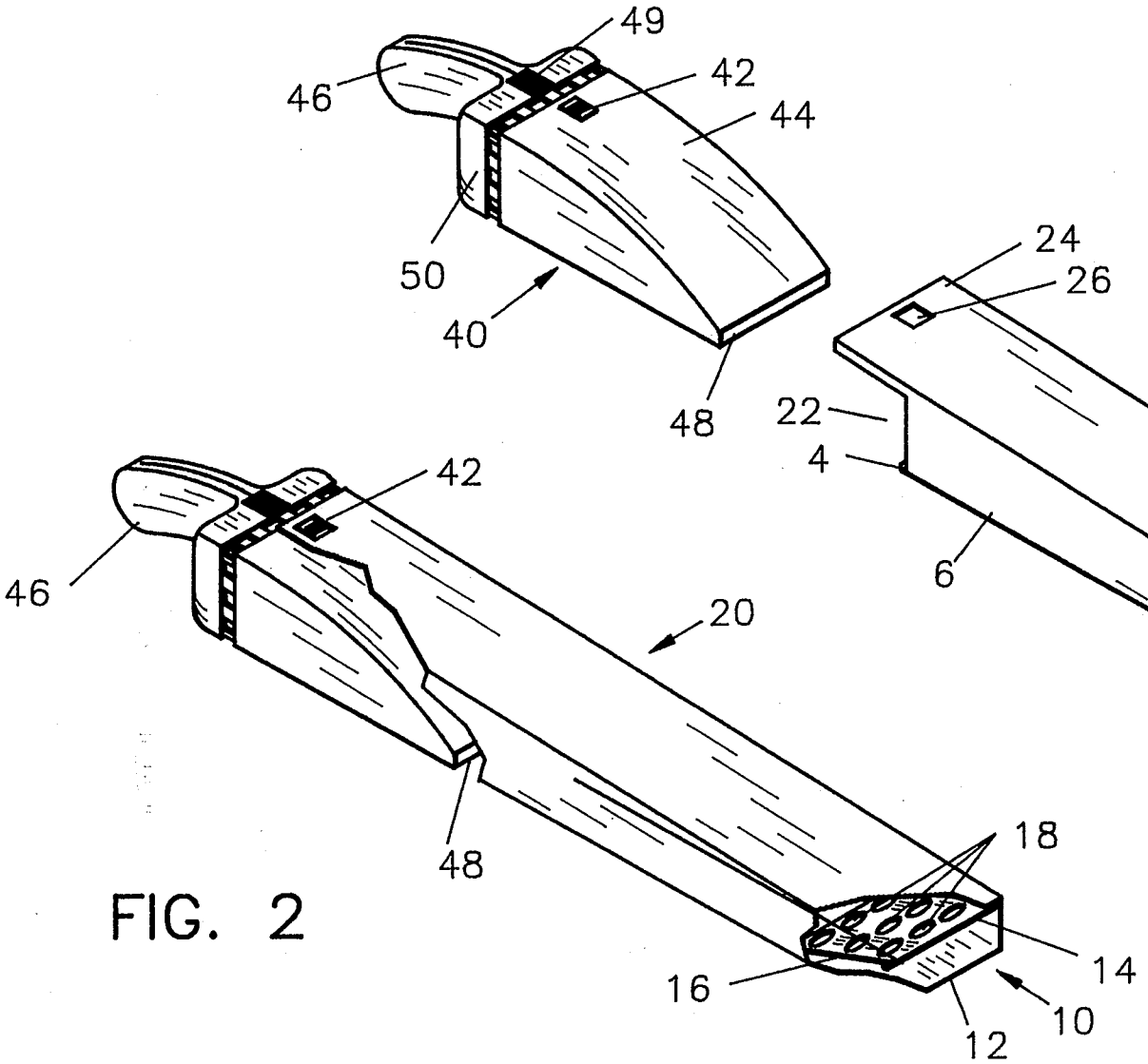
FIG. 2 is an elevated perspective view of the collection device of FIG. 1 shown attached to the portable vacuum cleaner.

As shown in FIGS. 1 through 3, the collection device 20 defines a generally tapered, elongated rectangular shape approximately thirty (30) inches in length and having a top wall 2, a bottom wall 4, and two side walls 6 surrounding an internal chamber 8.

Figure 4A:
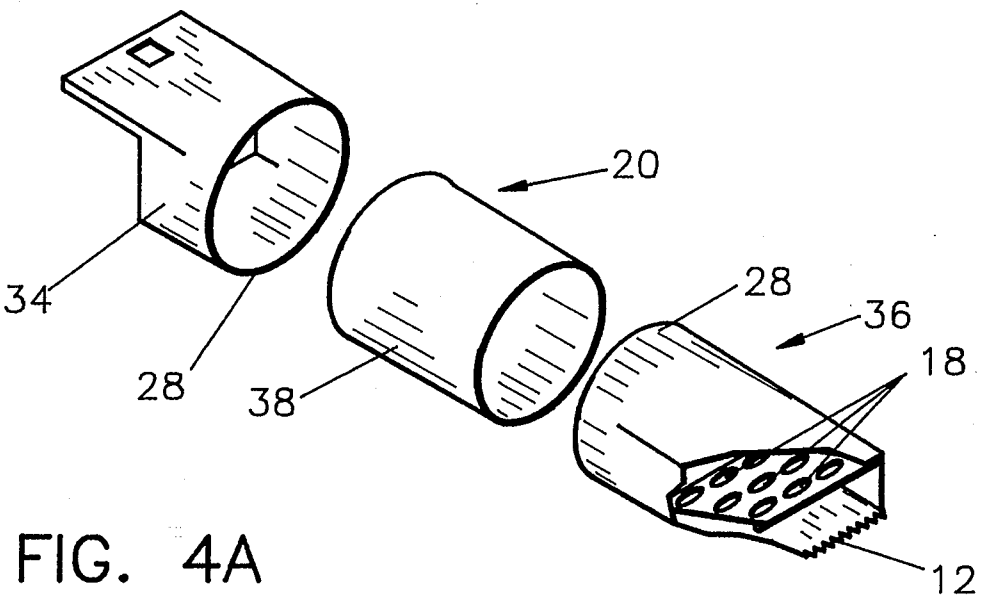
FIGS. 4A and 4B are exploded, perspective views of two other aspects of the collection device for attachment to hand held, portable vacuum cleaners.

An inlet end 10 defines an opening approximately 2 inches by 3 inches. The size of the inlet opening is generally larger than the inlets of the majority of vacuum cleaners thereby reducing the pressure differential and suction at the inlet 10. The bottom edge 12 of the opening may be rested against the collection surface when the collection device 20 is in use and is preferably an irregular edge as shown in FIG. 4A to prevent edge 12 from resting flat against the collection surface. The irregular edge 12 aids in preventing dirt and extraneous small, unwanted heavier particles on the work surface from entering the collection device 20.

A hinge 14 is provided on the inside of the top wall 2 for connection of a one-way inlet door 16 on the inside of the inlet 10. The inlet door 16 is preferably of slightly greater height than the height of the inlet opening 10 thereby preventing the door 16 from closing flush against the inlet opening 10. The width of the door 16 is sufficiently less than the width of the opening 10 thereby preventing contact between the door 16 and the side walls 6 to enable the door 16 to open freely. A plurality of perforations 18 are provided in the inlet door 16, and the purpose of the perforations will be described in connection with the operation of the collection device 20.

The outlet end 22 defines a generally rectangular opening approximately 4 inches by $2\frac{3}{4}$ inches. An extended portion 24 of the top wall 2 defines an aperture 26 designed to mount over the attachment button 42 for the collection bin 44 of the conventional hand held, portable vacuum cleaner 40. The vacuum shown in FIGS. 1 through 3A is sized to attach to a Black and Decker brand Dust Buster (TM) vacuum cleaner and it will be recognized by those skilled in the art that the outlet end 22 may be otherwise configured to attach to other conventional hand held portable vacuum cleaners. For instance, a friction gasket (not shown) may be placed around the edges of the outlet opening 22 or an elastic material strap (not shown) may be provided at the outlet end 22 to attach over the handle 46 of the vacuum cleaner 40.

Figure 3A:
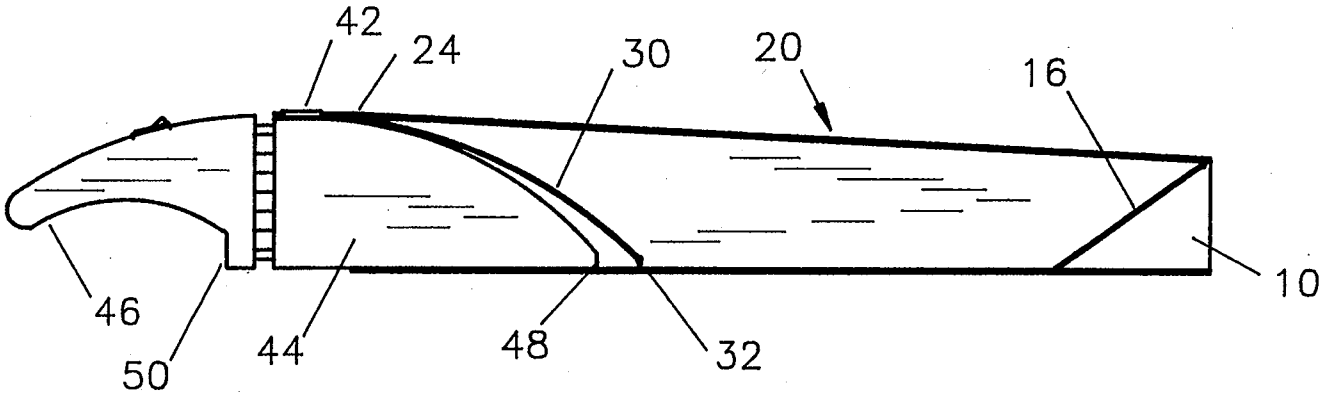
FIG. 3A is a side view of FIG. 2 and further showing an optional screen installed at the outlet end of the collection device.

When the collection device 20 is attached to the portable vacuum cleaner 40 as best seen in FIG. 3A, the inlet 48 of the vacuum cleaner 40 generally is angled slightly downward relative to the axis of the collection device 20.

When power is supplied to the vacuum cleaner 40, the resulting initial suction at 48 causes air to be drawn through the perforations 18 thereby clearing any collected loose-fill material away from the door 16 prior to an increase in fan speed and resulting suction causing the door 16 to move to the open position shown in FIG. 3A to admit additional lightweight packaging materials. The perforations 18 are not large enough to permit exit or entry of the commonly used lightweight, loose-fill packaging materials. As long as power is supplied to maintain the suction, the door 16 remains in the open position. In the absence of power, the door 16 will remain closed as long as the inlet end is angled slightly downwardly.

Figure 3B:
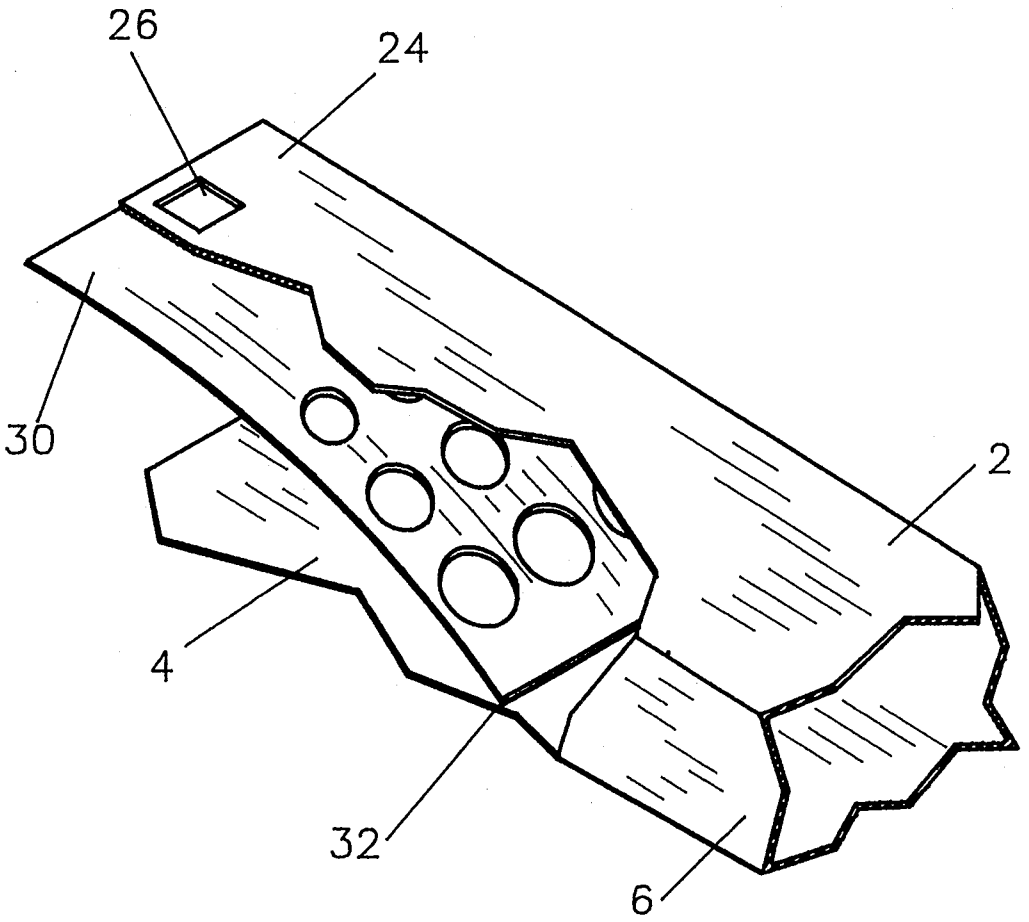
FIG. 3B is an enlarged elevated view showing the details of the screen.
Figure 10:
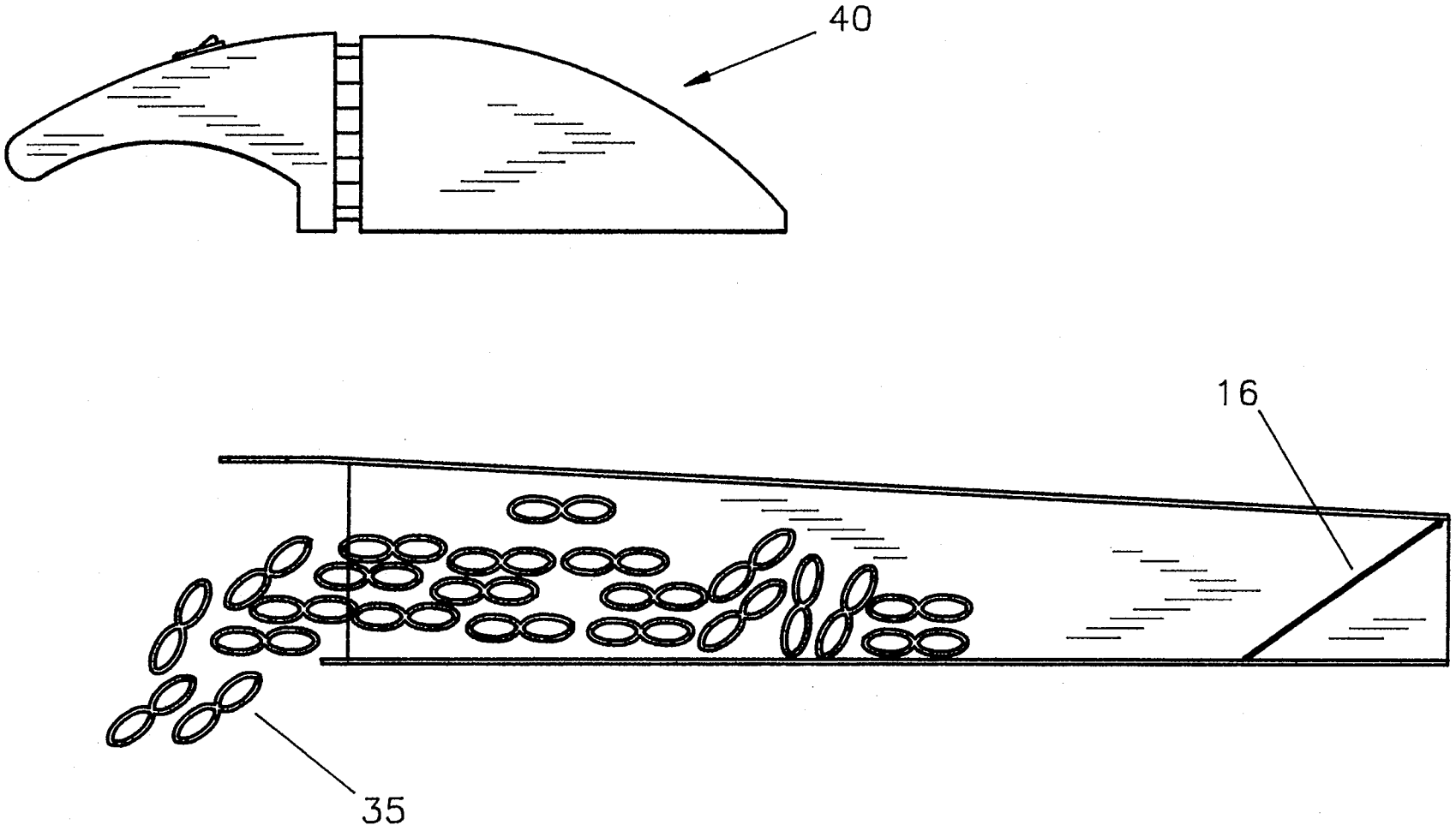
FIG. 10 shows emptying collected packaging materials from the collection device of FIG. 1.

Referring now to FIGS. 3A and 3B, an optional screen mechanism 30 may be provided to ensure that collected loose-fill materials do not enter the vacuum cleaner 40, although the downward angle and smaller opening of hand held vacuum inlets 48 generally is sufficient to prevent such entry. When a screen 30 is provided, it is preferably integrally formed with the extended portion 24 and hinged at 32 to the side wall 6 contiguous to the bottom wall 4. To empty the chamber 8 with the optional screen mechanism 30 installed, the screen 30 and the integral extended portion 24, drops down flush with the bottom wall 4. Without the optional screen 30, the collection device 20 is emptied of loose-fill packaging materials 35 by simply detaching it from the vacuum cleaner 40 and upending it as shown in FIG. 10.

Figure 4B:
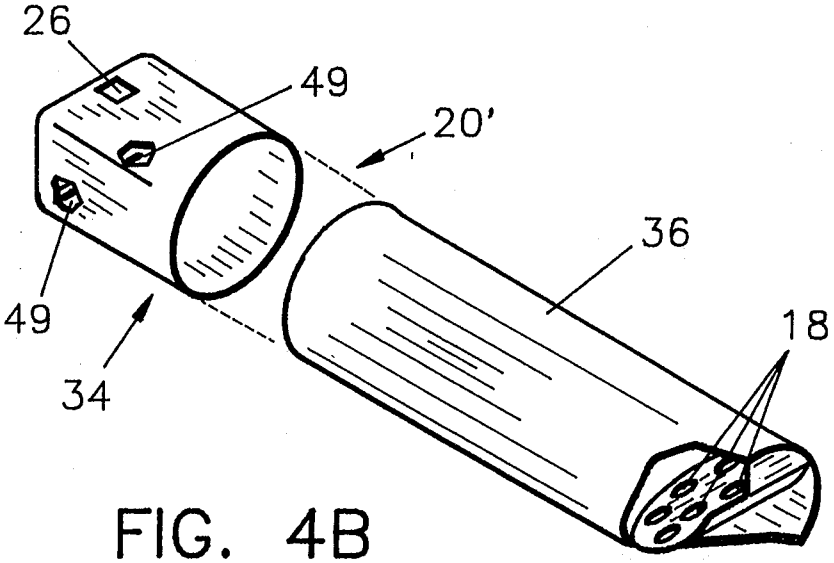

Referring now to FIGS. 4A and 4B, alternative generally cylindrical aspects of the collection device are shown at 20'. For ease and lowered cost of manufacture, the collection device 20' may be made in two or three sections which are then attached together. Preferably, the open ends of section 34 for attachment to the portable vacuum device and the collection section 36 are molded and include mounting flanges or channels 28 for attachment of conventional tubing 38 therebetween. The tubing 38 may be welded, soldered or glued to the end pieces. It will be recognized by those skilled in the art that the one piece collection device shown in FIGS. 1 through 3B may also be made from several assembled sections.

The vacuum cleaner attachment end 34 shown in FIG. 4B is configured to be directly attached to the body 50 of the vacuum cleaner 40 after removal of the dust bin 44. Slots 49 formed in the end 34 attach over mating bin attachment devices (not) shown on the body 50. In this aspect, the aperture 26' fits over the attachment button 42 and the conventional vacuum cleaner filter (not shown) is left in place.

Figure 5:
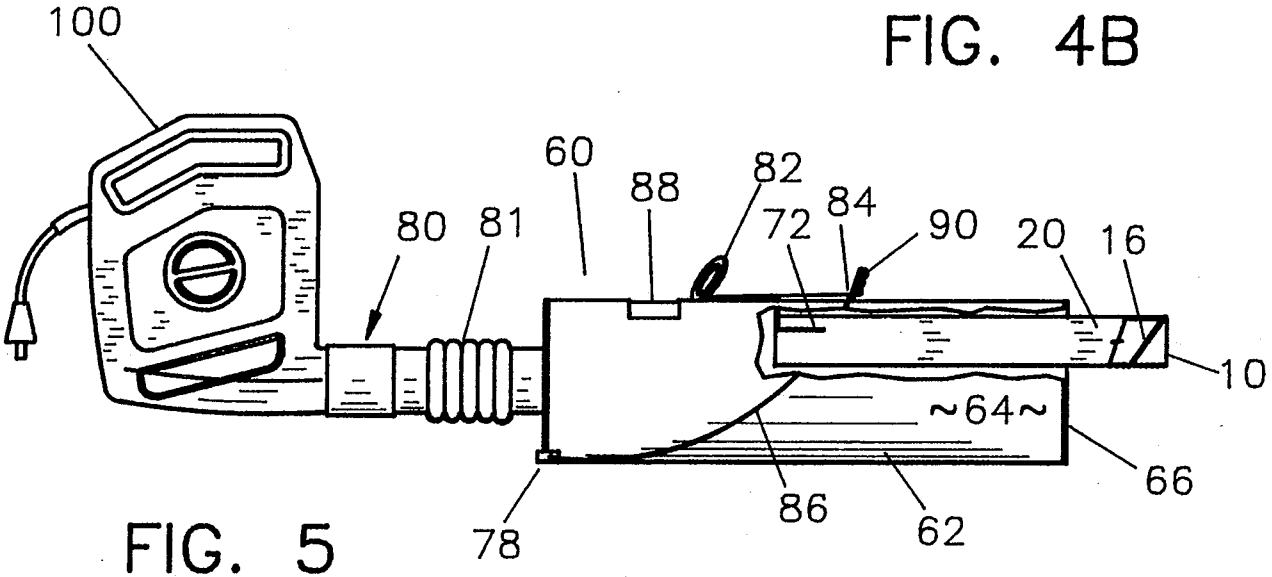
FIG. 5 is a side view of the collection device of FIGS. 1 through 4 shown installed within the larger collection receptacle which is attached to a conventional, full sized vacuum cleaner.

Referring now to FIG. 5 the collection device 20 is shown installed within a larger auxiliary collection receptacle 60 for attachment to the majority of conventional, full sized vacuum cleaners and blower devices. Receptacle 60 is particularly suitable for industrial use for larger collection operations.

Figure 6:
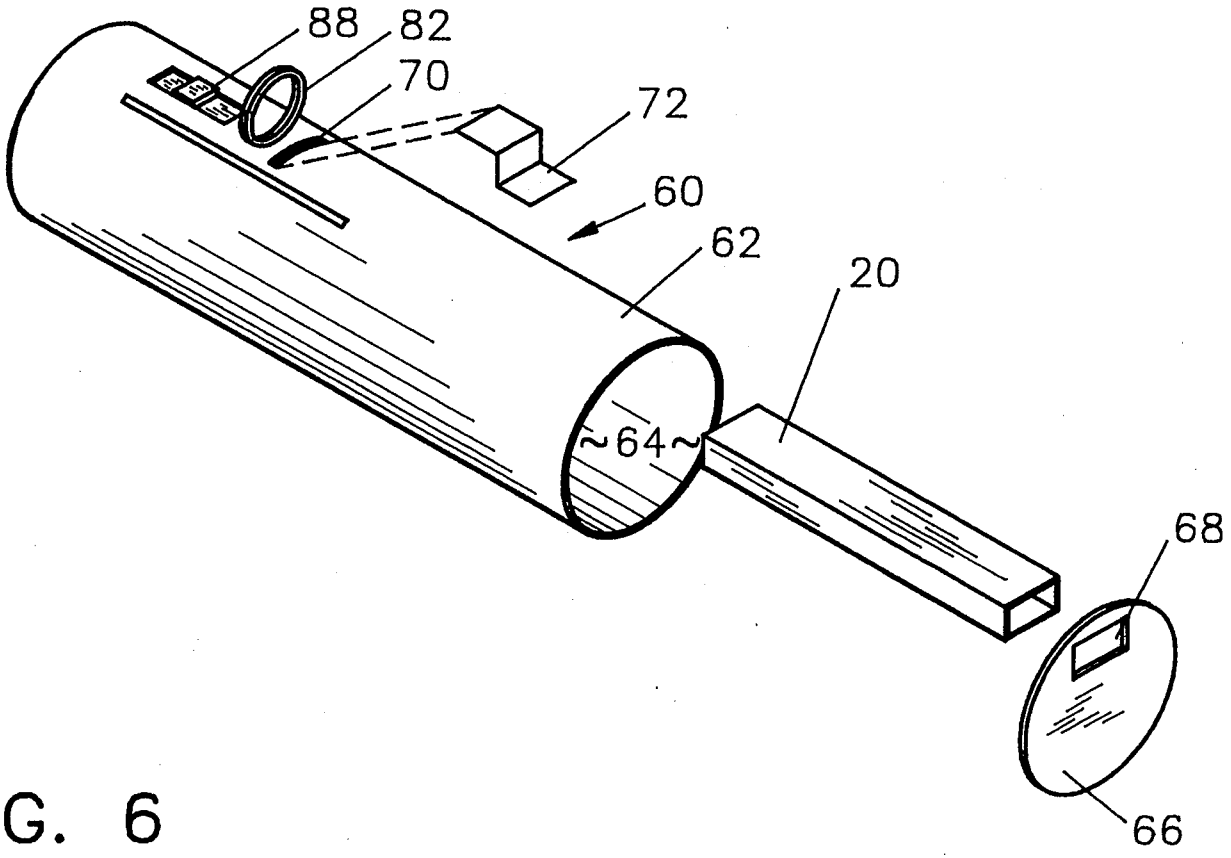
FIG. 6 is an exploded perspective, front view of the larger collection chamber and the collection device for installation therein.
Figure 7:
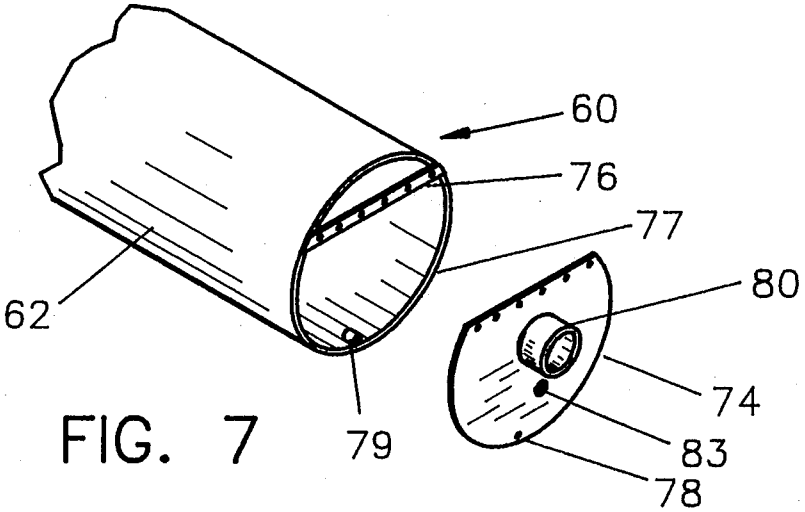
FIG. 7 is an exploded, rear view of the larger collection chamber showing the hinged, outlet door and the attachment mechanism.
Figure 8A:
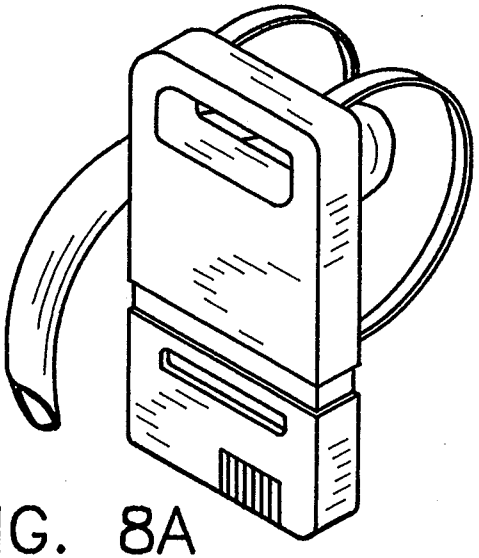
FIGS. 8A through 8D show other examples of conventional vacuum cleaners and blower devices suitable for use with the present invention.
Figure 8D:
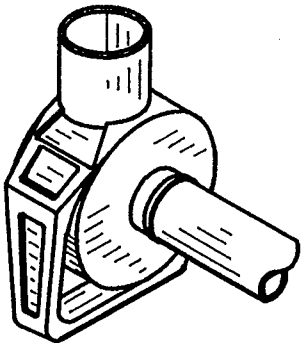
Figure 8C:
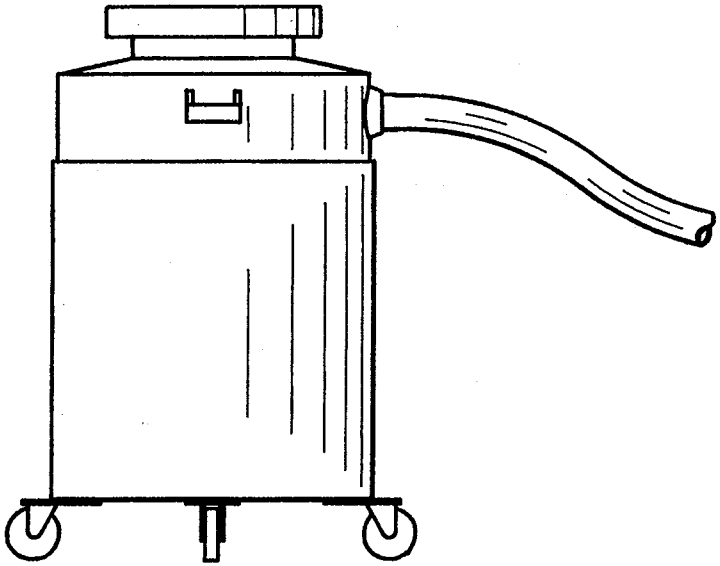
Figure 8B:
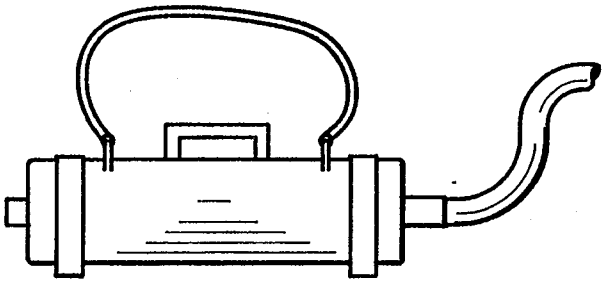

Referring now to FIGS. 5 through 7, receptacle 60 defines a generally circular outer wall 62 approximately 3 feet in length enclosing a large interior space 64. A front end wall 66 defines an opening 68 sized only slightly larger than the outer dimensions of the inlet end of the generally tapering collection device 20 to provide a relatively airtight connection. At approximately three quarters of the length of the receptacle 60 from the front end wall 66, a slot 70 is provided in the top of the outer wall 62 for mounting a generally Z-shaped bracket 72. The collection device 20 is installed in receptacle 60 by insertion through opening 68 and suspension over bracket 72 to assume the position shown in FIG. 5. As shown in FIG. 5, the inlet end 10 extends outwardly from the wall 66 and is used as described in connection with the collection device 20 to collect the lightweight, loose-fill packaging materials.

Referring now to FIG. 7, the receptacle 60 defines a rear outlet door 74 preferable attached to a hinge 76 installed in the circular wall 62. The door 74 is preferably fitted within a flange or channel 77 formed in the outer wall 62. An optional conventional latch 78 attaches to a mating latch mechanism 79 to maintain the door 74 in a closed position. A knob 79 is provided to open the door 74 manually. An optional screen (not shown) may be installed interior of the door 74.

Figure 9B:
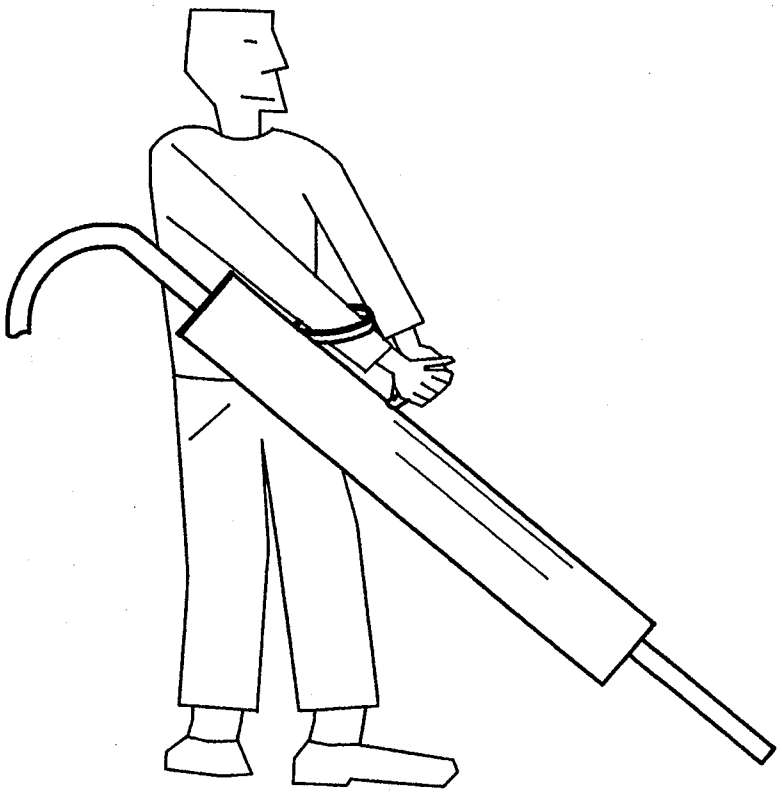
FIGS. 9A through 9D show examples of collection devices of the present invention with 9D showing a larger version of the FIG. 4A and 4B aspect attached to a coupling device leading to a full sized vacuum cleaner.

A conventional, universal coupler 80 is mounted through an aperture in the door 74. The coupler 80 enables the majority of conventional, full sized vacuum cleaner or reversible blower hoses, or hose couplers, to be attached to the receptacle 60. As shown in FIG. 5, the coupler 80 may include flexible connector tubing 81 and attach directly to the intake of the vacuum cleaner, or the coupler may attach to a hose of a vacuum cleaner as shown in FIG. 9B.

Referring now to FIG. 5, a ring 82 and hand or pistol grip 84, preferably an adjustable position forearm cradle support, may be installed on the top of the receptacle 80 to enable the user to easily control and direct the receptacle 60. A hook and latch strap extending from both sides of the ring 82 may be added to wrap around and stabilize the user's forearm. A shoulder strap may be connected to the ring 82 when desired for support. Additionally, a cable 86 may be provided between a spring release button 90, from a spring release mechanism installed within the pistol grip, and the latch 78 to automatically open the outlet door 74 to empty the receptacle 60. The latch 78 prevents the outlet door 74 from automatically opening, without the user operating the spring release mechanism, when the inlet end of the receptacle 60 is titled upward to empty the receptacle.

When attached to a conventional full sized, powered vacuum cleaner 100, as shown in FIG. 5, the resulting suction draws the material to be collected into the collection device 20 as previously described. When the materials reach the outlet end 22, they are free to drop down into the interior space 64. A slide panel window 88 provided in the top of the circular wall 62 may be variably opened and closed to vary the amount of suction at the inlet end 10.

FIGS. 8A through 8D show a variety of conventional vacuum devices and reversible blower devices all of which may be attached to the receptacle 60. It will be recognized by those skilled in the art that a hose or hose connection of any conventional device capable of outputting suction forces may be attached to the receptacle 60.

Figure 9A:
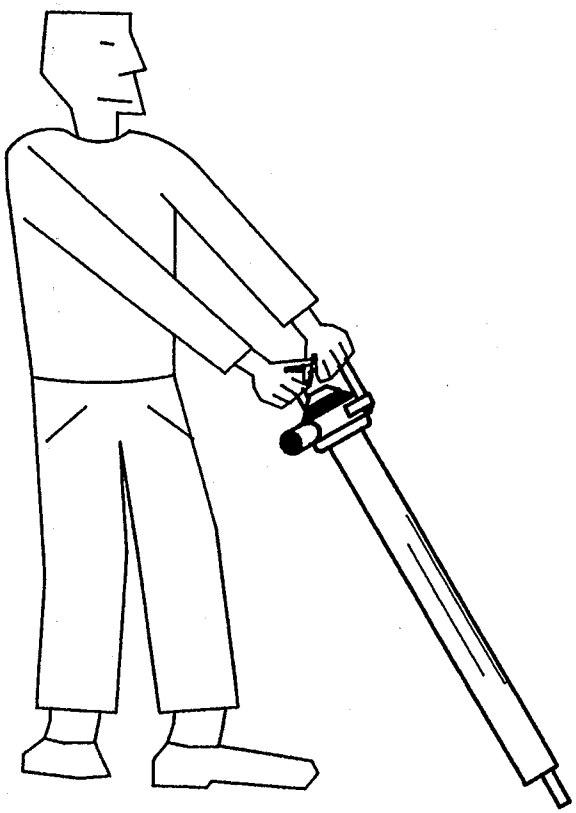
Figure 9D:
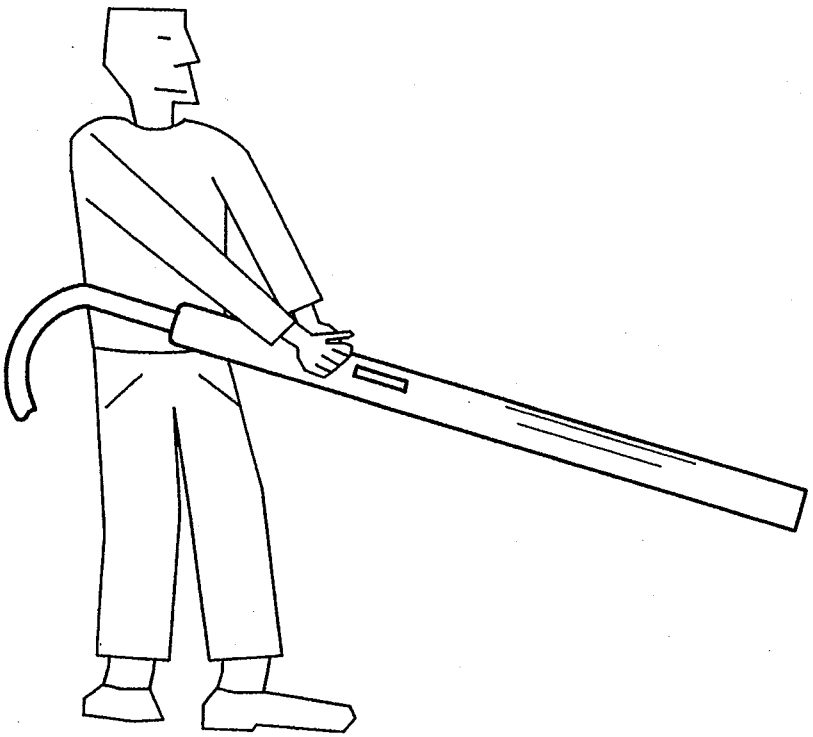
Figure 9C:
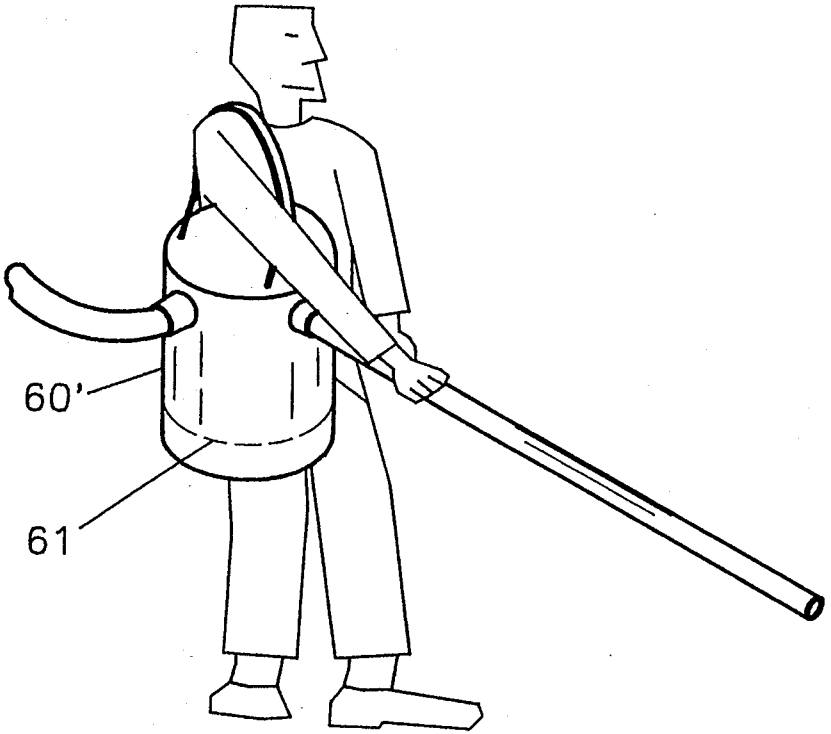

FIGS. 9A and 9B illustrate two, alternative sizes for the receptacle 60. FIGS. 9C illustrates an alternative receptacle 60'. The receptacle 60' may be made from a deformable material, either reinforced with rigid rings 61, or collapsible. FIG. 9D illustrates a larger version of the collection device shown in FIGS. 1 through 4B having the outlet end attached to a conventional coupling device which is, in turn, attached to a conventional full-sized vacuum device.

To those skilled in the art to which the present invention pertains, many widely varying embodiments and implementations of the principles of the present invention will be suggested from the foregoing. For instance, the dimensions and shapes described herein may be altered as desired the and the collection device may be configured to attach to any electric, gas, or alternatively powered motor driving a fan device to pump air out of an intake. Additionally, the inlet end of the collection device may be smaller when heavier substances, such as corn or potato starches, are used for construction of the loose-fill materials. The device may be formed as an integral apparatus with the power unit. The description and the disclosures presented herein are by way of illustration only and should not be considered to limit the present invention, the scope of which is more particularly set forth in the following claims.

What is claimed is:

1. An attachment for a powered vacuum cleaner or reversible blower device of the type pumping air to create suction at an intake, the attachment comprising:

collection body means defining at least one interior chamber for holding lightweight materials such as loose fill packaging materials for disposal or re-use;

coupling means defined in the collection body means for releasable attachment to the cleaner or blower device, the intake communicating with the interior chamber when the coupling means is attached to the cleaner or blower device;

inlet means communicating the ambience with the interior chamber, the suction provided at the inlet means being insufficient to attract an appreciable amount of dirt particles;

one-way door means for opening and closing the inlet means and defining at least one aperture for allowing air to move collected lightweight materials away from behind the one-way door means prior to opening thereof in response to initiation of suction flow through the chamber and closing in the cessation absence of suction flow; and outlet means in the collection body means for emptying the lightweight materials from the interior chamber.

2. The device of claim 1 further comprising screen means in the interior chamber to prevent the lightweight materials from entering the intake.

3. The device of claim 1 wherein the coupling means is an aperture for attachment over a knob of a conventional hand held, portable vacuum cleaner and the outlet means defines a perimeter having a shape designed to fit over a dust bin of the conventional hand held, portable vacuum cleaner.

4. The device of claim 1 wherein the coupling means is an aperture for attachment over a knob of a conventional hand held, portable vacuum cleaner and the outlet means defines a perimeter having a shape designed to attach to a flange of a conventional hand held, portable vacuum cleaner having a dust attachment removed.

5. The device of claim 1 wherein the coupling means is a universal hose attachment device for attaching to a hose of a full sized vacuum cleaner.

6. The device of claim 1 wherein the inlet means defines an irregular edge for resting on a surface bearing the lightweight materials for collection.

7. The device of claim 1 further comprising a spring release means for automatically opening the door means.

8. A lightweight, loose-fill material collection device for attachment to a powered machine of the type pumping air to create suction at an intake, the device comprising:

a body defining an interior space;

coupling means for attachment of the body to the powered machine;

means for flow communicating the intake of said powered machine with said interior chamber;

an inlet passage defined in the body and communicating with the interior space, the inlet passage having a door means defining a plurality of apertures sized to retain the lightweight materials within the body in the absence of suction, the door means opening when the powered machine creates suction, the suction moving the lightweight material through the inlet passage into the interior space, the suction being insufficient to attract an appreciable amount of dirt particles.

9. An attachment for a powered vacuum cleaner or reversible blower device of the type pumping air to create suction at an intake hose, the attachment comprising;

deformable collection bag means for holding lightweight materials such as loose fill packaging materials and having first and second connection means, the first connection means for releasable attachment to the intake hose;

inlet tube means defining a first end for attachment to the second connection means and a second end having a one-way door means defining at least one aperture and opening in response to suction and closing in the absence of suction, the at least one aperture enabling air to move collected lightweight materials away from behind the one-way door means upon the application of suction and prior to opening of the door means, the at least one aperture further enabling, in the absence of suction, unwanted dirt and particles to fall out of the inlet tube means while retaining the collected lightweight materials; and a strap means for suspending the collection bag means from a shoulder of a user.

10. The attachment of claim 9 wherein the deformable collection bag means further comprises outlet means for emptying collected lightweight materials.

11. The attachment of claim 9 wherein the deformable collection bag means is a collapsible bag.

12. The device of claim 8 further comprising spring means for automatically opening the door means.

13. The device of claim 9 further comprising spring means for automatically opening the door means.

14. The device of claim 1 further comprising a plurality of apertures sized to retain the lightweight materials with the body in the absence of suction.

* * * * *